US006725604B1

(12) United States Patent
Vanderpan

(10) Patent No.: US 6,725,604 B1
(45) Date of Patent: Apr. 27, 2004

(54) PRE-HUNG DOOR CORNER SPACER/RETAINER CLIPS AND PRE-HUNG DOOR ASSEMBLY

(75) Inventor: Ronald D. Vanderpan, Pacific Grove, CA (US)

(73) Assignee: Doorframer, Inc., Roseville, CA (US)

( * ) Notice: Subject to any disclaimer, the term of this patent is extended or adjusted under 35 U.S.C. 154(b) by 0 days.

(21) Appl. No.: 10/198,606

(22) Filed: Jul. 17, 2002

(51) Int. Cl.[7] ..... E06B 1/00; B65D 85/46

(52) U.S. Cl. ..... 49/380; 206/325

(58) Field of Search ..... 49/380; 206/591, 206/594, 325, 321; 52/204.1, 715, 656.4, 656.9; 248/220.1, 201; 403/401, 402, 403, 382

(56) References Cited

U.S. PATENT DOCUMENTS

| | | | | | |
|---|---|---|---|---|---|
| 1,667,279 | A | | 4/1928 | Allen | |
| 2,489,029 | A | | 11/1949 | Guerrant | |
| 2,742,146 | A | | 4/1956 | Lester, Jr. | |
| 2,887,219 | A | | 5/1959 | Lester, Jr. | |
| 2,929,495 | A | * | 3/1960 | Simonsen | 206/325 |
| 3,017,022 | A | | 1/1962 | Amundson | |
| 3,111,724 | A | | 11/1963 | Piekarski | |
| 3,205,982 | A | | 9/1965 | Chimienti | |
| 3,301,820 | A | | 1/1967 | Haendiges | |
| 4,518,279 | A | * | 5/1985 | Suttles | 403/231 |
| 4,636,105 | A | * | 1/1987 | Johansson | 403/205 |
| D307,078 | S | | 4/1990 | Guillemet | |
| 5,054,613 | A | | 10/1991 | Johansson | |
| 5,159,782 | A | | 11/1992 | Sales | |
| 5,255,727 | A | * | 10/1993 | Saruwatari et al. | 206/321 |
| 5,312,078 | A | * | 5/1994 | Marsh | 248/220.1 |
| 5,365,697 | A | | 11/1994 | Vanderpan | |
| 5,603,403 | A | | 2/1997 | Sather | |
| 5,655,332 | A | | 8/1997 | Papadopoulos | |
| 5,924,259 | A | * | 7/1999 | Marousek | 52/656.1 |
| 6,029,410 | A | * | 2/2000 | Westberg et al. | 52/204.1 |
| D427,894 | S | | 7/2000 | Benz et al. | |
| 6,276,526 | B1 | * | 8/2001 | Miller et al. | 206/321 |
| 6,470,637 | B2 | | 10/2002 | Gratz | |
| 6,488,247 | B1 | * | 12/2002 | Gonzalez | 248/201 |
| 6,532,704 | B2 | * | 3/2003 | Hart | 52/202 |

* cited by examiner

*Primary Examiner*—Hugh B. Thompson, II
(74) *Attorney, Agent, or Firm*—Gray Cary Ware & Freidenrich LLP

(57) ABSTRACT

A door framing apparatus provided wherein a set of four spacer/retainer clips permits easy installation of a pre-hung door jamb assembly by a single installer. The clips maintain a uniform reveal space around the door, protects the assemblies from damage during shipping and holds the door together during shipment and installation.

63 Claims, 11 Drawing Sheets

PRE-HUNG DOOR CORNER SPACER/RETAINER CLIPS AND PRE-HUNG DOOR ASSEMBLY

FIELD OF THE INVENTION

The present invention relates to an apparatus for the packaging and installation of a pre-hung door jamb assembly.

BACKGROUND OF THE INVENTION

In a large percentage of installed doors, either commercial or residential, builders purchase the doors as pre-hung door jamb assemblies. Namely, the door is already hung in the jamb assembly when it arrives to the builder. This is accomplished by attaching the door to one side of the jamb assembly by a hinge or hinges, or other equivalent securing means. The other side of the door is usually provided with a lockset and knob opening. The jamb member positioned immediately adjacent to the lockset and knob opening side is fixed with a latch or striker plate opening so that the door can be securely shut after it has been installed.

When a builder purchases a pre-hung door jamb assembly, the door will typically be shipped inside of the door jamb. That is, the door will be "closed" as opposed to "open" in the jamb. To keep the door closed during shipping, the manufacturer may directly fasten the door and the jamb together on the side opposite the hinges. Alternatively, the manufacturer may space the jamb from the door by a plurality of shipping stabilizers. These stabilizers are often thin pieces of wood, paper or cardboard. The stabilizers are secured and held in place in between the door and jamb either by nail or by adhesive. The entire assembly may then be strapped with a cellophane material or the like. For commercial metal pre-hung doors, L-shaped stabilizing brackets may be bolted into the edge of the door and the front of the jamb. Stanley Tools uses these types of L-shaped brackets.

In most cases, when the pre-hung door jamb assembly arrives at the installation site, the builder frees the jamb member opposite the hinges by removing any nails or strapping that restricts the swinging of the door. Generally, the builder removes all of the pieces attached to the door jamb assembly during shipping, save the hinges. In this manner, the door may swing inside the jamb at the hinges, thus facilitating the installation of the assembly into the door frame. In order to install the door, the builder first aligns the assembly within the door frame. Then, the door is opened. Next, the builder nails the door jamb into the king stud. Finally, the door is opened and closed to test the reveal space of the door. The reveal space is the gap in between the closed door and the jamb. Typically, no ruler is used when measuring the reveal space. The builder completes the installation by making any necessary adjustments to the reveal, space.

Ideally, two installers work together while installing the door. One of the installers may keep the free swinging door shut, while the other aligns the assembly with the door frame. Typically, however, only one installer must attempt to align the assembly, while keeping the door shut at the same time. An installer cannot leave the nails or strapping in place to keep the door shut since they cannot be practically removed once the assembly is placed within the door frame. This one-man process usually results in a poorly aligned door. A single installer can generally install a pre-hung door jamb assembly in 20 to 30 minutes. While there is a significant time savings in the installation of pre-hung door jamb assemblies over the installation of doors that are not pre-hung, it is desirable to further reduce the time to install pre-hung doors while improving the alignment of the assembly in the frame.

Another difficulty inherent in the installation of a pre-hung door assembly is maintaining a desirable and uniform reveal space between the door and jamb. Although the manufacturer may secure the door to the jamb with hinges, leaving a desirable reveal space, the door may shift inside of the assembly during shipping. Thus, the installer may need to realign the door and jamb to reset the reveal space. This realignment adds time to the installation process. To circumvent this problem, manufacturers have used spacers positioned between the door and jamb to maintain the reveal space. The spacers have a thickness substantially equal to the desired reveal space, 3/32' for an inside door and 1/8' for an outside door. Since the door and jamb may shift and separate, the spacers may become dislodged, necessitating the use of replacement spacers.

Another problem with pre-hung door jamb assemblies is the damage to the assemblies during the shipping process. When hinges are used to attach the door to the jamb, the hinges protrude from the assembly. That is, the hinges are not flush with the door. Thus, when the assemblies are stacked on top of or side-by-side next to each other or otherwise come into contact, the protruding hinges may dent, scratch or otherwise damage another assembly. It is desirable to avoid these types of damage.

Accordingly, it is desirable to provide a more efficient device that will aid in maintaining the reveal space between the door and jamb during shipping and installation. Additionally, it is desirable to provide a device that will allow a door to be installed easily by a single installer. Finally, it is desirable to provide a device which will protect the assemblies from damage during shipping. It is to these ends that the present invention is directed.

SUMMARY OF THE INVENTION

In accordance with this invention, a set of four spacer/retainer clips is provided wherein each of the clips comprise a plastic or substantially similar material that is shaped in such a way as to attach to the jamb and keep the door shut, while maintaining a uniform reveal space. between the door and jamb. The two clips that attach to the top corners of the door jamb assembly are physically identical, while the two clips that attach to the bottom of the door jamb assembly are similar, but are mirror images of each other.

To accomplish these functions, the invention involves the use of four spacer/retainer clips that hold the four corners of the door to the corresponding location inside the jamb. When the clips are properly attached to the jamb, the clips keep the door shut, while maintaining a uniform reveal space. Additionally, by keeping the door shut, a single installer may align the assembly with greater ease. Furthermore, when attached, the clips provide separation to prevent the protruding hinges from damaging other doors during shipping. The clips also protect the surface of the assembly from scratching and marring. Finally, the clips may be removed during the last stages of the installation process, leaving a negligible effect on the appearance of the assembly.

The invention allows a pre-hung door jamb assembly to be installed rapidly and precisely into any door frame, either residential or commercial. Furthermore, the invention facilitates the installation of the assembly by a single installer. Additionally, the invention allows the assembly to be shipped without fear of damage or misalignment of the reveal space.

Thus, in accordance with the invention, a clip for temporarily securing a door to a first door jamb member and a second door jamb member is provided. The clip has a base region and first and second flaps that extend down from the base region and attach to a first and second edge of the base region. The clip also has a support member that is attached to the base region at the intersection of the first and second edges of the base region so that the support member extending down from the base region. The clip also has a bracket having a first and second portion that is positioned underneath the base region of the clip wherein a first door jamb member is positionable between the first portion of the bracket and the first flap, a second door jamb member is positionable between the second portion of the bracket and the second flap and the ends of the first door jamb member and the second door jamb member are postionable within the support member.

In accordance with another aspect of the invention, a clip for temporarily securing a bottom of a door to a first door jamb member is provided. The clip comprises a base region and a first and second flaps that extend down from the base region and attach to a first and second edge of the base region. The clip also has a spacer that is positioned underneath the base region of the clip wherein a first door jamb member is positionable between the spacer and the first flap and a door is positionable between the spacer and the second flap.

In accordance with yet another aspect of the invention, a pre-hung door assembly is provided. The assembly has a first and second vertical door jamb members spaced apart from each other, a horizontal jamb member connected between the first and second vertical door jamb members and a door positioned between the first and second vertical door jamb members and the horizontal jamb member and secured to the first vertical door jamb member by hinges. The assembly also has a first top corner clip that secures the first vertical door jamb member to the horizontal jamb member and the door and a second top corner clip that secures the second vertical door jamb member to the horizontal jamb member and the door. The assembly also has a bottom left corner clip that secures the bottom of the second vertical door jamb member to the bottom of the door and a bottom right corner clip that secures that secures the bottom of the first vertical door jamb member to the bottom of the door wherein the first top corner clip, the second top corner clip, the bottom left corner clip and the bottom right corner clip each hold the door shut during installation.

DETAILED DESCRIPTION OF A PREFERRED EMBODIMENT

The invention is particularly applicable to its use in the shipping and installation of prehung door jamb assemblies. It is in this context that the invention will be described. It will be appreciated, however, that the spacer/retainer clips in accordance with the invention have greater utility, such as to the installation of doors that are not pre-hung.

Figure 1:
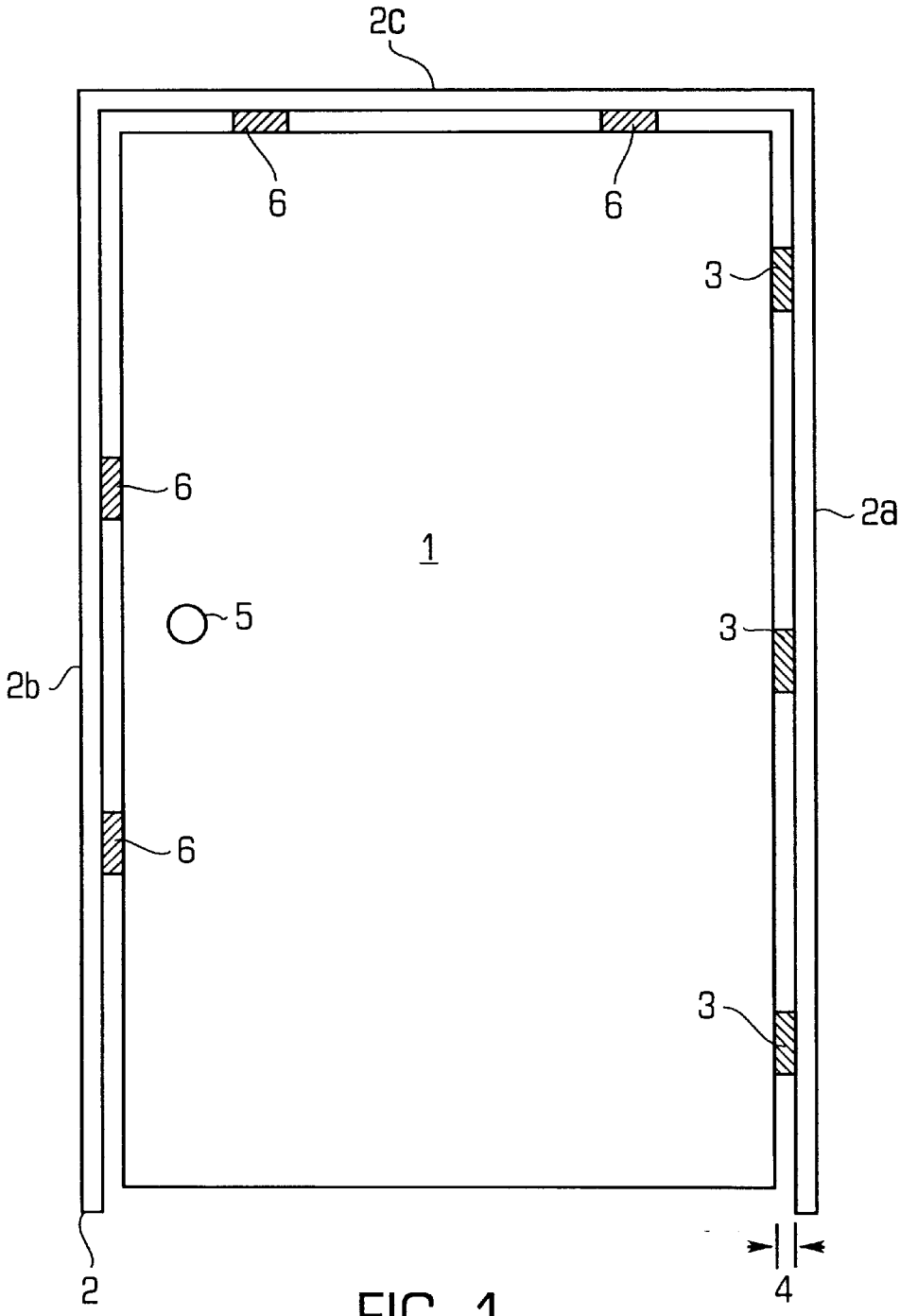
FIG. 1 is a front elevational view of a conventional pre-hung door jamb assembly using conventional spacers to maintain the reveal space between the jamb and door.

FIG. 1 illustrates a conventional pre-hung door jamb assembly. A door 1 is mounted to a jamb assembly 2 by one or more hinges 3. The jamb assembly 2 includes first and second, substantially parallel, spaced apart vertically extending door jamb members 2*a,* 2*b* and a horizontally extending door jamb rail member 2*c* that connects the first and second vertical door jamb members 2*a,* 2*b.* The hinges 3 securely attach the door 1 to the first vertically extending door jamb member 2*a.* Typically, at least two hinges 3 are used to secure the door 1 to the first vertically extending door jamb member 2*a.* On the side opposite the hinges 3, the door is prepared with a lockset/knob opening 5. A small space 4 between the door 1 and the jamb members 2*a–c* is referred to as "reveal" space. The reveal space 4 functions as a tolerance for the door 1 so that the door 1 can freely open and close within the jamb assembly 2 and enhances the appearance of the door. The reveal space 4 is typically small. For example, on most residential doors, the reveal space 4 may be 3/32' for an inside door and 1/8' for an outside door, although smaller or larger reveal spaces 4 are also used. For a pre-hung door, the door 1 and jamb assembly 2 are delivered to the construction site pre-assembled so that the builder may easily install the door 1 and jamb assembly 2 into a door opening.

In order to maintain the reveal space 4, the door 1 and jamb assembly 2 may be equipped with a plurality of stabilizing spacers 6. The spacers 6 are often thin pieces of wood, paper, plastic or cardboard. The spacers 6 are secured and held in place in between the door 1 and the jamb members 2*a–c* either by nail or adhesive. The disadvantage to these spacers 6 is that when they are removed, either a hole or residual adhesive may be left behind. In order to keep the door shut during shipping, the entire door 1 and jamb assembly 2 may be wrapped in cellophane material or the like. Despite this wrapping, the hinges 3 protrude from the surface of the door 1 and jamb assembly 2 and therefore may damage other assemblies during shipping.

Figure 2:
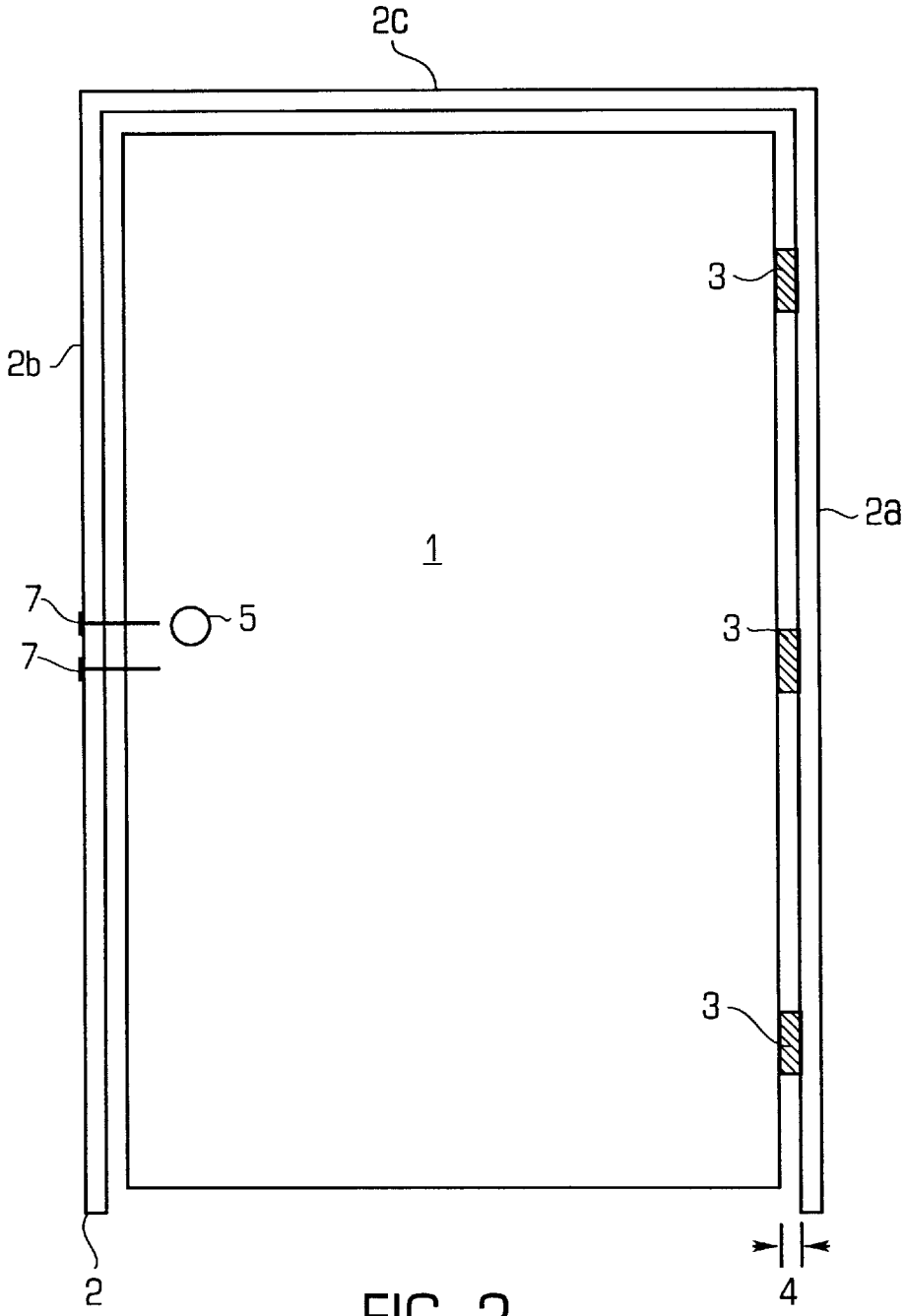
FIG. 2 is a front elevational view of a conventional pre-hung door jamb assembly using conventional screws, nails or other fastening devices to fasten the door directly to the jamb.

FIG. 2 illustrates another conventional pre-hung door jamb assembly. In FIG. 2, a plurality of stabilizing spacers 6 is not used to maintain the reveal space 4. Instead, the door 1 is simply attached to the second vertically extending door jamb member 2*b* by a fastening device or devices 7 (usually nails or screws) near the lockset/knob opening 5. While the fastening device or devices 7 attempt to hold the door 1 rigidly within the jamb assembly 2, the door 1 may move within the jamb assembly 2 during shipping. As a result, the hinges 3 may loosen or become dislodged. Therefore, the reveal space 4 loses its uniformity and must be reset when the door 1 and jamb assembly 2 is installed. Furthermore, when the fastening device or devices 7 are removed, a noticeable hole or holes may be left in the door 1 and/or the second vertically extending door jamb member 2*b*. The fastening devices 7 are also dangerous to the installer and can cause damage.

FIGS. 1 and 2 illustrate the conventional manners in which pre-hung door jamb assemblies are assembled and shipped. Furthermore, some pre-hung door jamb assemblies use a board nailed across the jamb to protect from hinge damage, but the removal of the board leaves unsightly holes in the door. FIGS. 1 and 2 also illustrate the problems associated with the conventional pre-hung door jamb assemblies. It is these problems which the invention seeks to overcome. Accordingly, a pre-hung door jamb assembly and the retainer clips in accordance with the invention will now be described. First, a representative example of a top corner clip in accordance with the invention and a bottom left corner clip will be described.

Figure 3:
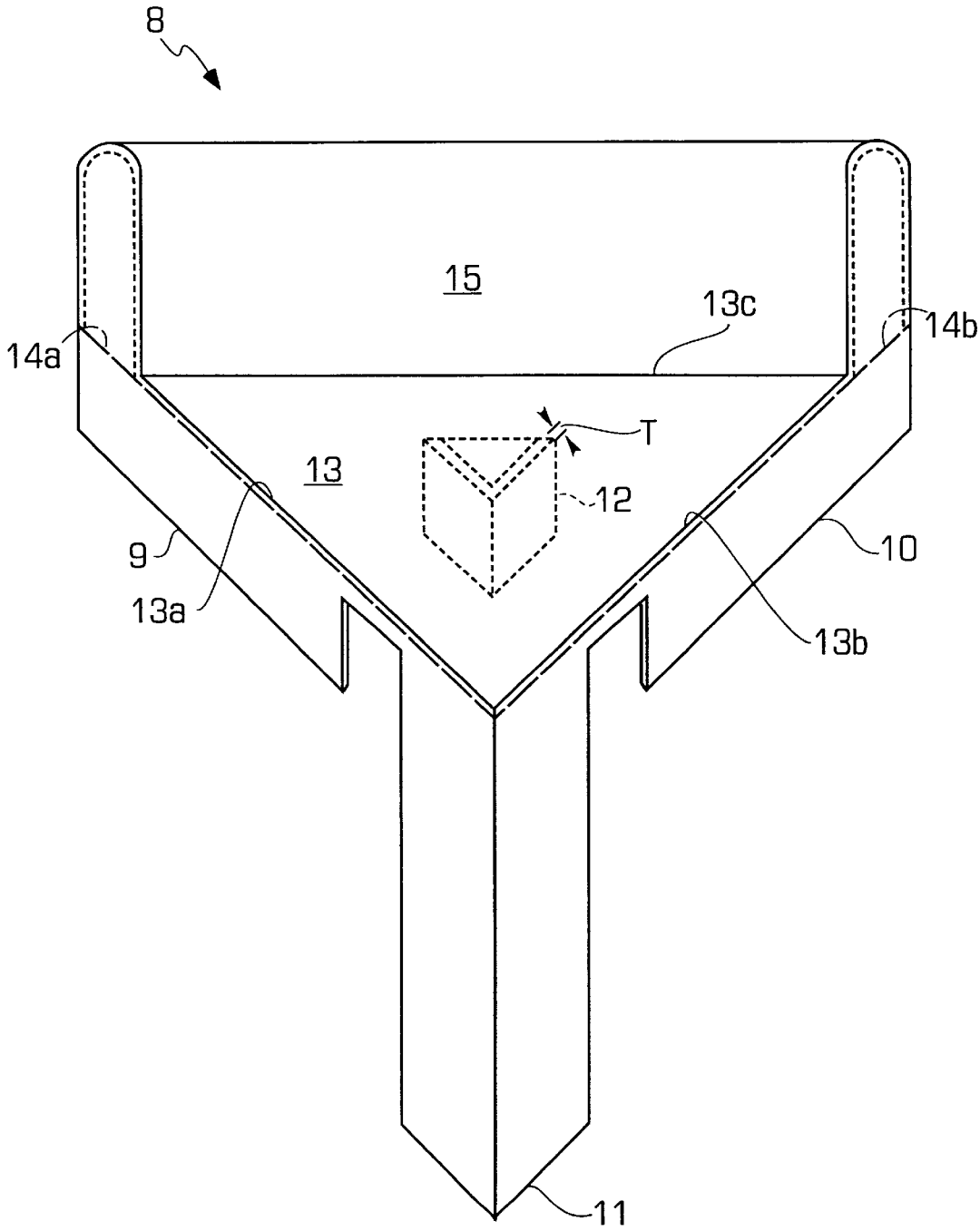
FIG. 3 is an isometric view of a top corner clip in accordance with the present invention.
Figure 7A:
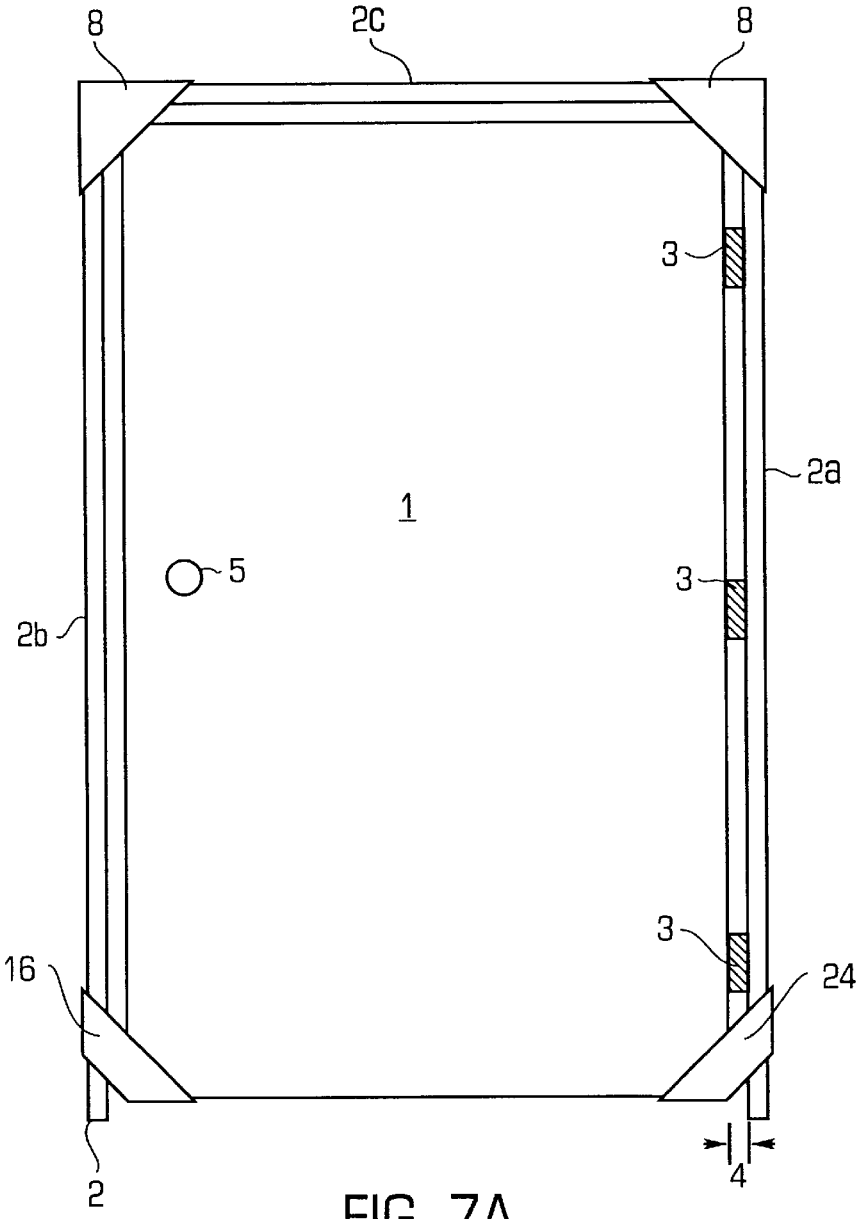
FIG. 7A is a front view of a pre-hung door jamb assembly in accordance with the invention with all four spacer/retainer clips of the present invention attached to the door jamb.
Figure 7B:
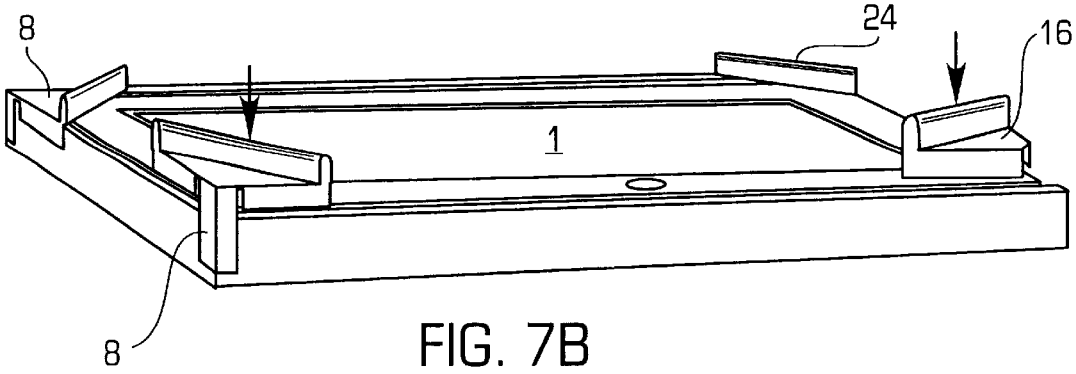
FIG. 7B is a perspective view of the pre-hung door jamb assembly in accordance with the invention with all four spacer/retainer clips of the present invention attached to the door jamb.

FIG. 3 is an isometric view of a top corner clip 8. In a preferred embodiment, two top corner clips 8, one for each top corner of the door 1 and jamb assembly 2 are used as shown in FIGS. 7A and 7B. The two top corner clips 8 are physically and functionally identical. Therefore, a top corner clip 8 will be described and that description describes both top corner clips. For illustrative purposes, FIG. 3 illustrates the top left corner clip 8. The top corner clip 8 has planar symmetry. The top corner clip 8 may be made from various types of plastic or other suitable materials. The top corner clip 8 and the other clips described herein may be molded, formed or assembled, using one or more different materials. For example, the base region of the top corner clip may be molded from plastic and a protective ridge may be formed by adding a foam bar as a protector. The clips may be made out of foam,Styrofoam, or any plastic material with sufficient properties, such as polypropylene or low density polyethylene (LDPE). The top and bottom clips in accordance with the invention are preferable manufactured as a molded one-piece product using LDPE.

The top corner clip 8 is constructed around an isosceles triangular base 13 that is also a right triangle. The triangular base 13 has a first edge 13*a,* a second edge 13*b* and a third edge 13*c* wherein the third edge is the hypotenuse of the right triangle. A rectangular first vertical flap 9 is located underneath the first edge 13*a* of the triangular base 13 and a rectangular second vertical flap 10 is located underneath the second edge 13*b* of the triangular base 13. The first and second vertical flaps 9,10 connect to the triangular base 13 at substantially right angles and preferably at right angles (perpendicular). The top corner clip 8 further includes an L-shaped vertical support piece 11 which is located underneath the corner of the of the edges 13*a,* 13*b* (i.e. at the right angle of the isosceles triangular base 13) and extends down from the triangular base 13. The vertical support piece 11 connects to the triangular base 13 at substantially a right angle.

The triangular base 13, the first and second flaps 9, 10 and the vertical support piece 11 ensure that the door 1 remains closed as long as the top corner clip 8 is attached as described below in more detail. Furthermore, the top corner clip 8 is scored with score lines 14*a,* 14*b* at the intersection of the first vertical flap 9, second vertical flap 10 and vertical support piece 11 and the isosceles triangular base 13. The scoring (thinning of the material) allows the top corner clip 8 to be separated easily during installation into smaller pieces. Namely, after the door jamb installation is complete, the builder can tear or cut the top corner clip 8 along the score lines 14*a–b* and remove the isosceles triangular base 13 and a protective ridge 15 (and discard it), leaving only the first vertical flap 9, second vertical flap 10 and vertical support piece 11 attached to the jamb members 2*b–c* when the installation of the door jamb assembly is completed. Thus, after the door 1 and jamb assembly 2 are installed, the remaining portions (first vertical flap 9, second vertical flap 10 and vertical support piece 11) are left in place and covered by decorative trim casing. Instead of the score lines described above, the clip may have one or more tear strips which permits the user to tear the clip or one or more pry holes which facilitate the removal of the clip if the clip does not have score lines or tear strips.

Figure 4A:
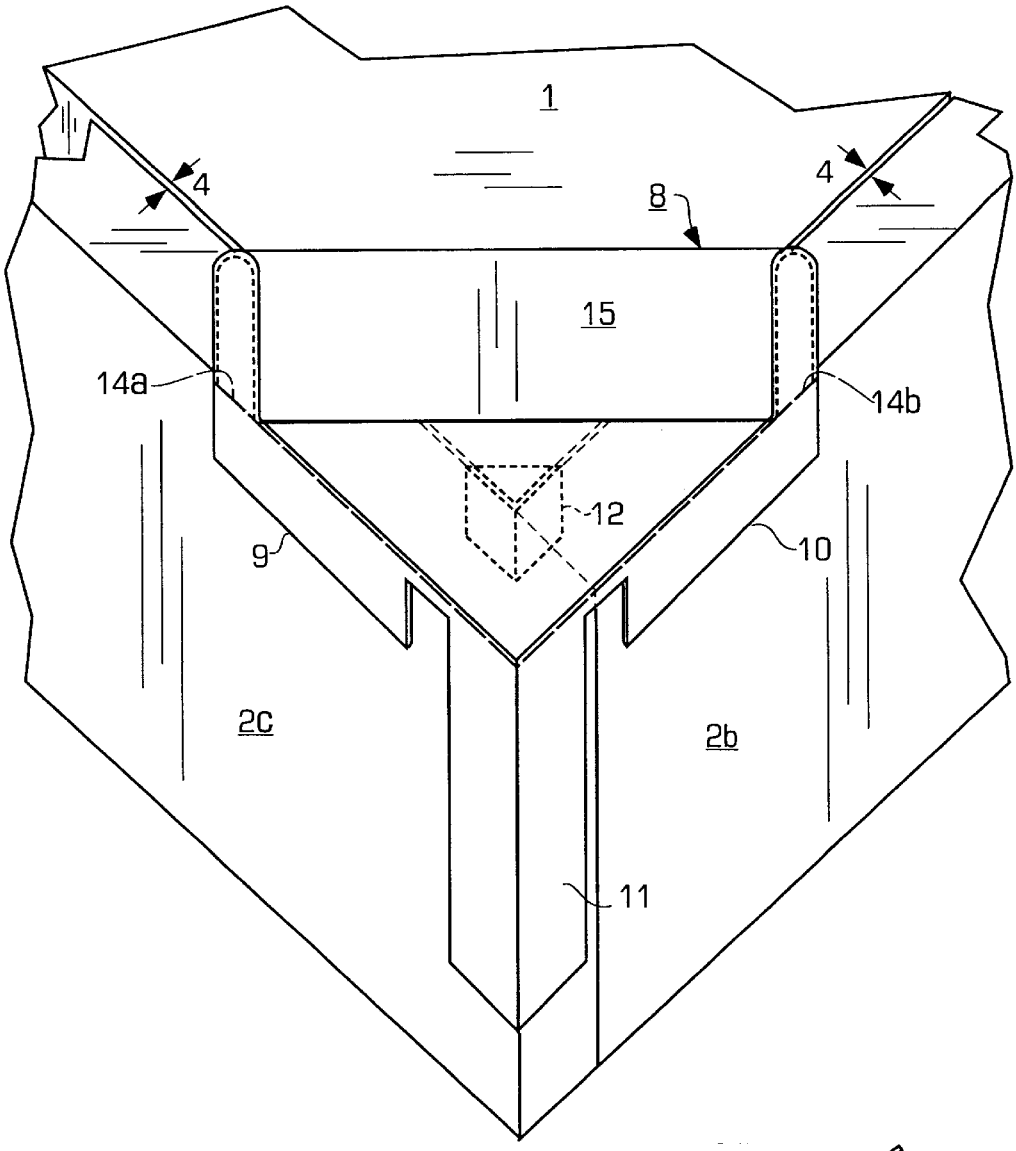
FIG. 4A is a perspective view, partially broken away, of the top corner clip shown in FIG. 3 attached to the door jamb.

As shown in FIG. 4A, the top corner clip 8 is shaped in such a way as to attach to the intersection of the horizontal extending door jamb rail member 2*c* and the second vertically extending door jamb member 2*b*. In particular, the first vertical flap 9 attaches to the horizontal extending door jamb rail member 2*c* by staple or other fastening device. The second vertical flap 10 attaches to the second vertically extending door jamb member 2*b* by staple or other fastening device. The vertical support piece 11 attaches to jamb members 2*b–c* at the intersection of the horizontal extending door jamb rail member 2*c* and the second vertically extending door jamb member 2*b* by staple or other fastening device. By attaching to the intersection of the horizontal extending door jamb rail member 2*c* and the second vertically extending door jamb member 2*b,* the vertical support piece 11 provides stability at the joint of the jamb assembly 2.

Returning to FIG. 3, the top corner clip 8 further includes an L-shaped bracket 12 that is attached to the bottom of the isosceles triangular base 13, near the center of the isosceles triangular base 13. The L-shaped bracket sits at a distance away from the first vertical flap 9 and the second vertical flap 10 that is substantially equal to the width of the second vertically extending door jamb member 2*b* and the horizontal extending door jamb rail member 2*c*. Thus, as shown in FIG. 4A, the horizontal extending door jamb rail member 2*c* sits between the first vertical flap 9 and the L-shaped bracket 12 and the second vertically extending door jamb member 2*b* sits between the second vertical flap 10 and the L-shaped bracket 12 so that the top corner clip is properly aligned with the door and jamb assembly. Furthermore, the intersection of the second vertically extending door jamb member 2*b* and the horizontal extending door jamb rail member 2*c* sits against the vertical support piece 11 to properly align the top clip 8. In addition, the top left corner of the door 1 sits on the inside of the L-shaped bracket 12 so that the door is prevented from moving when the top corner clip 8 is attached. Furthermore, in the preferred embodiment of the invention, the L-shaped bracket 12 has a thickness, T, substantially equal to a desired reveal space 4 of the assembly. The top corner clip may also be used as a skid plate when the door jamb assembly is stored on its top and for additional joint support. Therefore, the top corner clip 8 will maintain the reveal space between the jamb members 2*b–c* and the door 1 during the installation of the door jamb assembly and permit a single installer to install the pre-hung door jamb assembly. The top clip 8 also ensures that the door remains closed during the installation process (to help a single installer to install the pre-hung door jamb assembly).

Returning to FIG. 3, the top corner clip 8 also includes a protective ridge 15 that rises above the third edge 13*c* of the isosceles triangular base 13. The protective ridge may be integrally formed with the base region and flaps in a preferred embodiment, but the protective ridge may also be a separate piece of material which is later added onto the base region. For example, the base region and flaps may be made of a plastic material and the protective ridge may be made of a Styrofoam material which is secured to the base region in some manner. The protective ridge 15 is positioned opposite the vertical support piece 11 (i.e. opposite the right angle of the isosceles triangular base 13 and along the hypotenuse of the triangular base) and partially above the first vertical flap 9 and second vertical flap 10. In a preferred embodiment, the protective ridge 15 stands approximately 1" above the isosceles triangular base 13. The protective ridge 15 serves several functions. First, it provides a gap between assemblies if the assemblies are stacked during shipping. This prevents the protruding hinges 3 from damaging other assemblies. Furthermore, the protective ridge 15 provides a grip for the installer to use during the installation of the door 1 and jamb assembly 2. Finally, the protective ridge 15 provides a location for the installer to hold while he tears the top corner clip 8 along the score lines 14*a–b*.

Figure 4B:
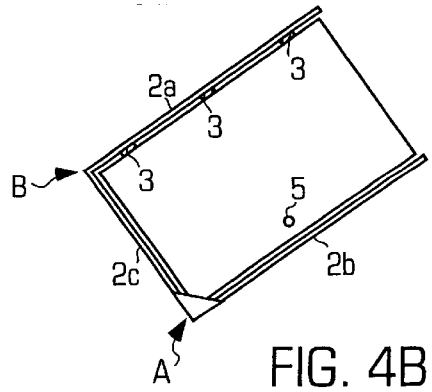
FIG. 4B illustrates the position of the top corner clip relative to the door jamb assembly.

FIG. 4A illustrates the top corner clip. 8 attached to the door 1 and jamb assembly 2. The left vertical flap 9 attaches to the horizontally extending jamb rail member 2*c,* while the right vertical flap 10 attaches to the second vertically extending door jamb member 2*b*. The vertical support piece 11 attaches to the joint formed by the intersection of the second vertically extending door jamb member 2*b* and the horizontal extending door jamb rail member 2*c*. While keeping the door 1 closed, top corner clip 8 also maintains a uniform reveal space 4 between the door 1 and jamb assembly 2. The top corner clip 8 may be torn apart along the score lines 14*a–b,* leaving the left vertical flap 9, right vertical flap 10 and vertical support piece 11 attached to the jamb members 2*b–c*. FIG. 4B illustrates a position "A" of the top corner clip 8 with respect to the pre-hung door jamb assembly. As described above, the top corner clip 8 is also used for another corner position "B" as shown in FIG. 4B.

Figure 4C:
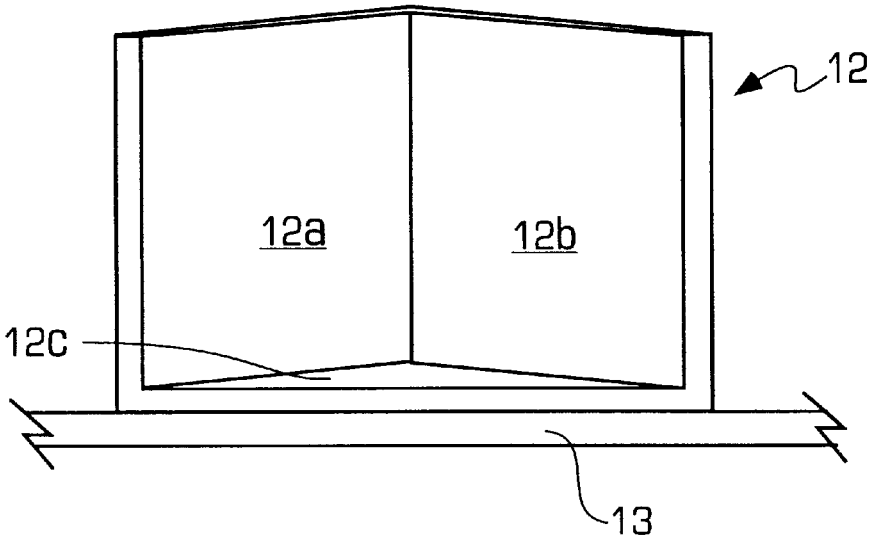
FIG. 4C illustrates more details of the L-shaped bracket.

FIG. 4C illustrates more details of the L-shaped bracket 12. In particular, a first portion 12*a* and a second portion 12*b* of the bracket are shown intersecting at a point to form an L-shape. The bracket 12 further comprises a raised bottom portion 12*c* as shown which has some predetermined height, such as 50 thousands of an inch in a preferred embodiment and is raised above the base region 13 as shown. The raised bottom portion 12*c,* when the top corner clip is secured to the door jamb assembly, contacts the door and pushes the door closed. Now, the bottom left corner clip in accordance with the invention will be described in more detail.

Figure 5A:
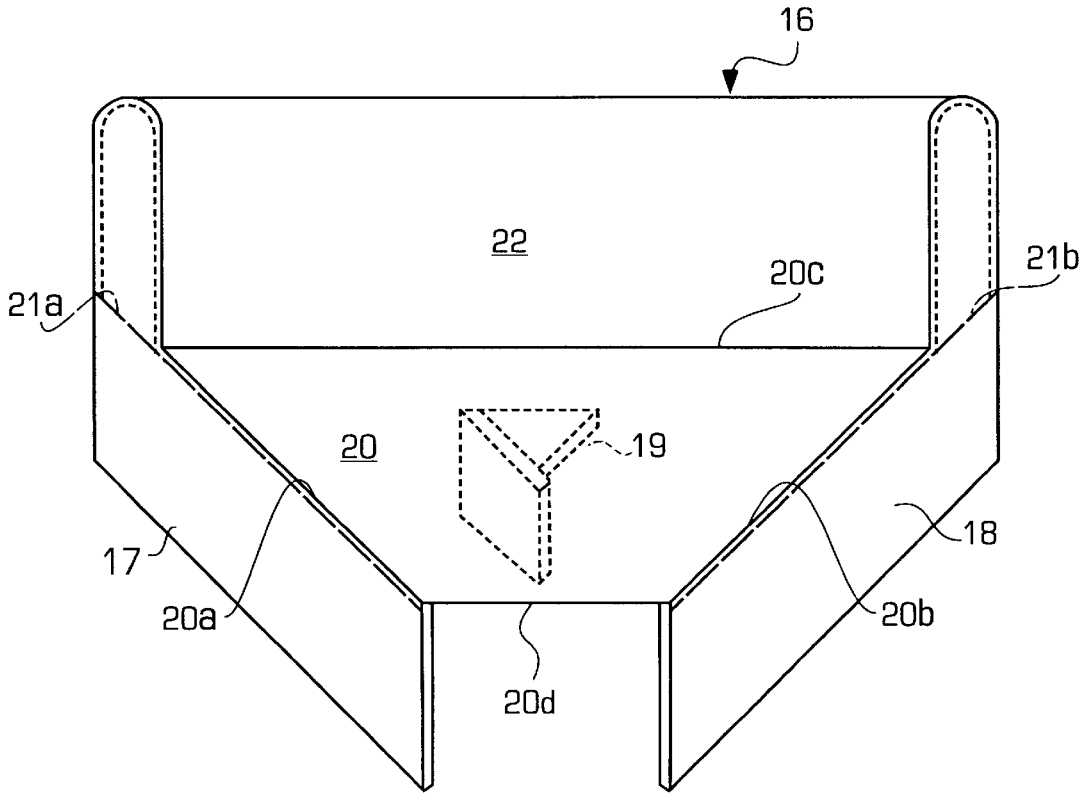
FIG. 5A is an isometric view of a bottom left corner clip in accordance with the present invention.
Figure 5B:
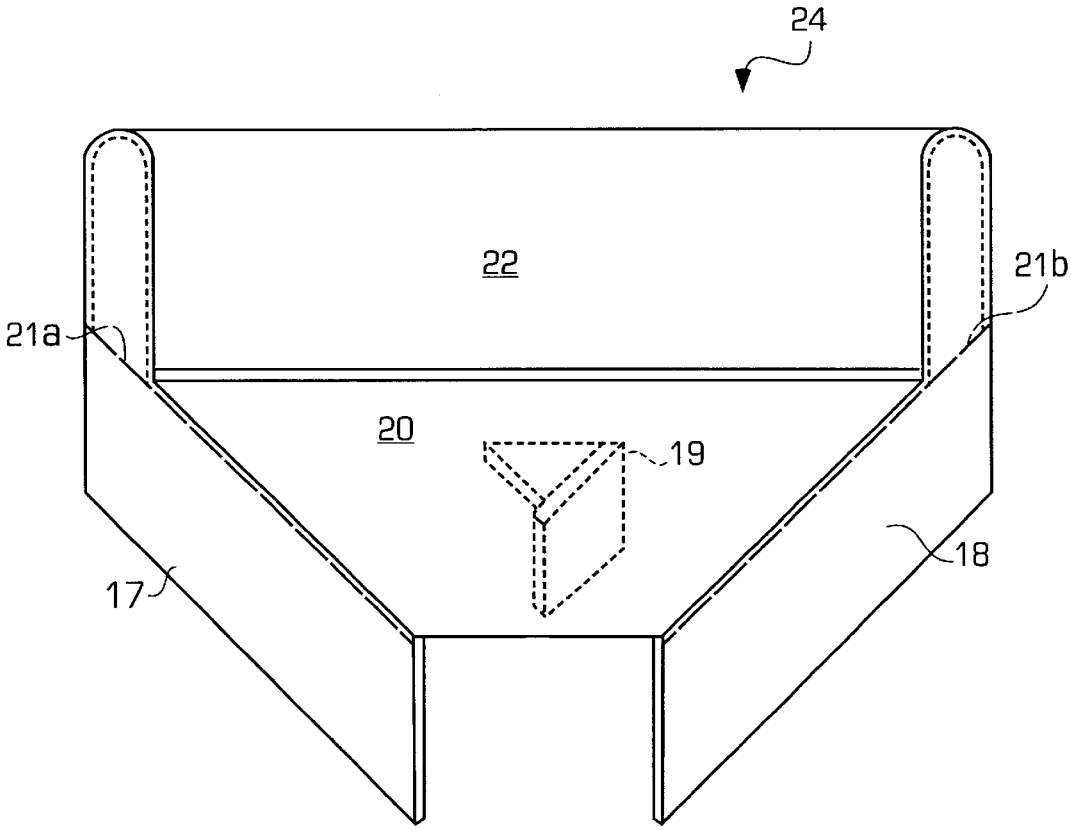
FIG. 5B is an isometric view of a bottom right corner clip in accordance with the present invention.

FIG. 5A illustrates an isometric view of a bottom left corner clip 16. The preferred embodiment uses two clips 16, 24 on the bottom of the door 1 as shown in FIGS. 7A and 7B. The bottom right corner clip 24 attaches to the first vertically extending door jamb member 2*a* and to the bottom right corner of the door 1, while the bottom left corner clip 16 attaches to the second vertically extending door jamb member 2*b* and the bottom left corner of the door 1. These bottom corner clips 16, 24 are mirror images of each other wherein only a flat vertical spacer 19 is positioned differently as shown in FIGS. 5A and 5B. Therefore, other than the different position of the flat vertical spacer 19, the structure of the two bottom clips is identical and therefore only the bottom left corner clip 16 will be described in detail. The bottom left corner clip 16 and bottom right corner clip 24 are made from various plastics or other suitable materials. The bottom corner clips 16, 24 may be molded, formed or assembled, using one or more different materials. For example, the base region of the top corner clip may be molded from plastic and a protective ridge may be formed by adding a foam bar as a protector. The clips may be made out of foam, Styrofoam, or any plastic material with sufficient properties, such as polypropylene or low density polyethylene (LDPE). The top and bottom clips in accordance with the invention are preferable manufactured as a molded one-piece product using LDPE.

Returning to FIG. 5A, the bottom left corner clip 16 comprises a trapezoidal planar base 20. The trapezoidal planar base 20 comprises a first non-parallel edge 20*a,* a second non-parallel edge 20*b,* a first parallel edge 20*c* and a second parallel edge 20*d* as shown. The clip 16 further comprises a first vertical flap 17 located underneath the first non-parallel edge 20*a* of the base 20 and a second vertical flap 18 located underneath the second non-parallel edge 20*b* of the base 20. The first vertical flap 17 and second vertical flap 18 connect to the planar top surface 20 at substantially right angles and preferably right angles. This trapezoidal planar base 20 and the first and second flaps 17, 18 ensure that the door 1 remains closed as long as the bottom left corner clip 16 is attached. Furthermore, the bottom left corner clip 16 is scored at score lines 21*a,* 21*b* at the intersection of the first vertical flap 17, the second vertical flap 18 and the trapezoidal planar base 20. The scoring (thinning of the material) allows the bottom left corner clip 16 to be separated easily during installation into smaller pieces. Namely, the builder can tear the bottom left corner clip 16 along the score lines 21*a–b* and remove the isosceles trapezoidal planar base 20 and a protective ridge 22 (and discard it) when the installation is complete, leaving only the first vertical flap 17 attached to the second vertically extending door jamb member 2*b* and second vertical flap 18 attached to the bottom of door 1. After the door 1 and jamb assembly 2 is installed, the remaining portions (first vertical flap 17 and second vertical flap 18) are covered by decorative trim casing or are not visible. Instead of the score lines described above, the clip may have one or more tear strips which permits the user to tear the clip or one or more pry holes which facilitate the removal of the clip if the clip does not have score lines or tear strips.

Figure 6C:
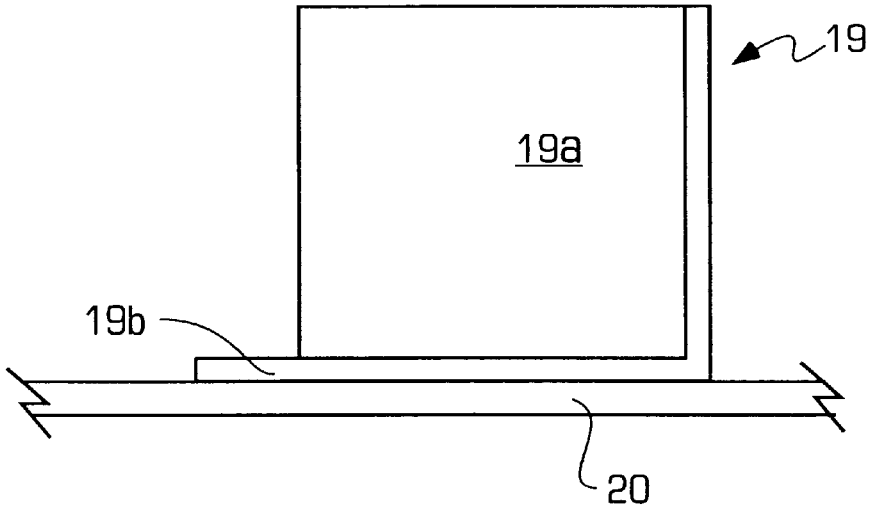
FIG. 6C illustrates more details of the flat vertical spacer.
Figure 6A:
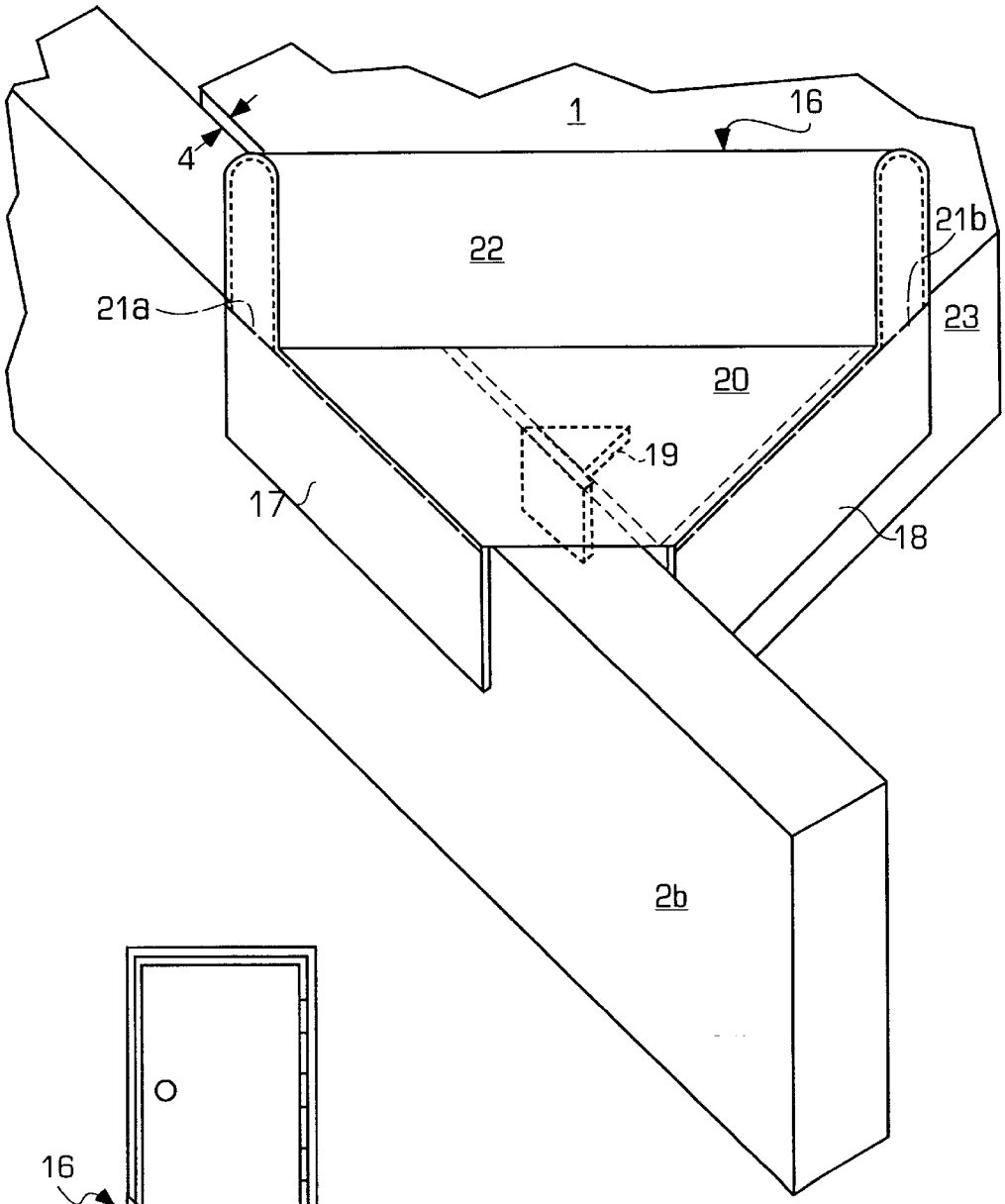
FIG. 6A is a perspective view, partially broken away, of the bottom left corner clip of the present invention attached to the door jamb.

As shown in FIG. 6A, the bottom left corner clip 16 is shaped in such a way as to attach to the bottom of the second vertically extending door jamb member 2*b,* while keeping the door 1 closed. The first vertical flap 17 attaches to the bottom of the second vertically extending door jamb member 2*b* by staple or other fastening device. The second vertical flap 18 attaches to a bottom edge 23 of the door 1 by staple or other fastening device. When the first vertical flap 17 and second vertical flap 18 are attached, the door 1 is held securely closed during installation. The bottom left corner clip 16 further includes a flat vertical spacer 19 that is attached to the bottom of the trapezoidal planar base 20 and is between the first vertical flap 17 and second vertical flap 18. The flat vertical spacer 19 sits at a distance away from the first vertical flap 17 (and parallel to the first vertical flap 17) that is substantially equal to the width of jamb member 2*b*. Thus, the second vertically extending door jamb member 2*b* fits in between first vertical flap 17 and the left side of the flat vertical spacer 19 when the bottom left corner clip 16 is attached to the door 1 and jamb assembly 2.

For the right bottom corner clip 24 shown in FIG. 5B, the flat vertical spacer 19 is sits at a distance away from the second vertical flap 18 (and parallel to the second vertical flap 18) that is substantially equal to the width of jamb member 2*a*. Thus, for the bottom right clip 24, the second vertically extending door jamb member 2*a* fits in between second vertical flap 18 and the left side of the flat vertical spacer 19 when the bottom right corner clip 24 is attached to the door 1 and jamb assembly 2.

The flat vertical spacer 19 has a thickness substantially equal to the desired reveal space 4 of the assembly. The bottom left corner of the door 1 sits against the right side of the flat vertical spacer 19 and the second vertical flap 18 when the bottom left corner clip 16 is attached to the door 1 and jamb assembly 2. Thus, the door 1 is prevented from moving and the reveal space 4 is maintained during installation.

The bottom left corner clip 16 (and the bottom right corner clip 24 shown in FIG. 5B) also includes a protective ridge 22 that rises above the third edge 20*c* of the trapezoidal planar base 20. The protective ridge 22 is positioned on the widest edge of the trapezoidal planar base 20, and partially above the first vertical flap 17 and second vertical flap 18. The protective ridge may be integrally formed with the base region and flaps in a preferred embodiment, but the protective ridge may also be a separate piece of material which is later added onto the base region. For example, the base region and flaps may be made of a plastic material and the protective ridge may be made of a Styrofoam material which is secured to the base region in some manner. The protective ridge 22 stands approximately 1" above the trapezoidal planar base 20. The protective ridge 22 serves several functions. First, it provides a gap between assemblies if the assemblies are stacked (either on top of each other or side-by-side to each other) during shipping. This prevents the protruding hinges 3 from damaging other assemblies. Furthermore, the protective ridge 22 provides a grip for the installer to use during the installation of the door 1 and jamb assembly 2. Finally, the protective ridge 22 provides a location for the installer to hold while he tears the bottom left corner clip 18 along the score lines 21*a–b*.

Figure 6B:
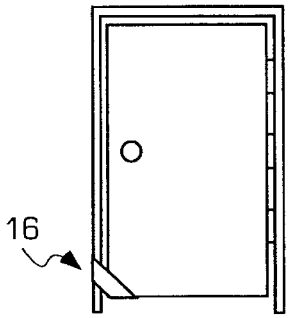
FIG. 6B illustrates the position of the bottom left corner clip relative to the door jamb assembly.

FIG. 6A illustrates the bottom left corner clip 16 attached to the door 1 and jamb assembly 2. The first vertical flap 17 attaches to the second vertically extending door jamb member 2*b*, while the second vertical flap 18 attaches to the bottom edge 23 of the door 1. While keeping the door 1 closed, the bottom left corner clip 16 also maintains a uniform reveal space 4 between the door 1 and jamb assembly 2. The bottom left corner clip 16 may be torn apart along the score lines 21*a–b*, leaving the left vertical flap 17 and the right vertical flap 18 attached to the second vertically extending door jamb member 2*b* and the bottom edge 23 of the door 1, respectively. FIG. 6B illustrates the position the bottom left corner clip 16.

FIG. 6C illustrates more details of the spacer 19. In particular, a first portion 19*a* of the spacer 19 is shown. The spacer 19 further comprises a raised bottom portion 19*b* as shown which has some predetermined height, such as 50 thousands of an inch in a preferred embodiment that is raised above the base region 20 as shown. The raised bottom portion 19*b*, when the bottom corner clip is secured to the door jamb assembly, contacts the door and pushes the door closed.

Figure 6D:
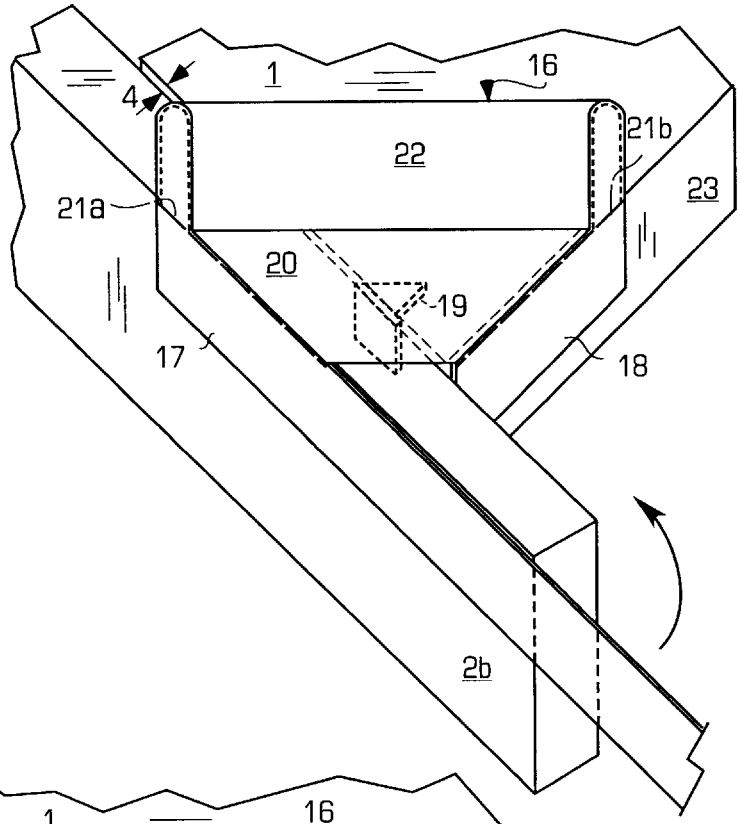
FIG. 6D illustrates another embodiment of the bottom clip in accordance with the invention with an elongated flap.
Figure 6E:
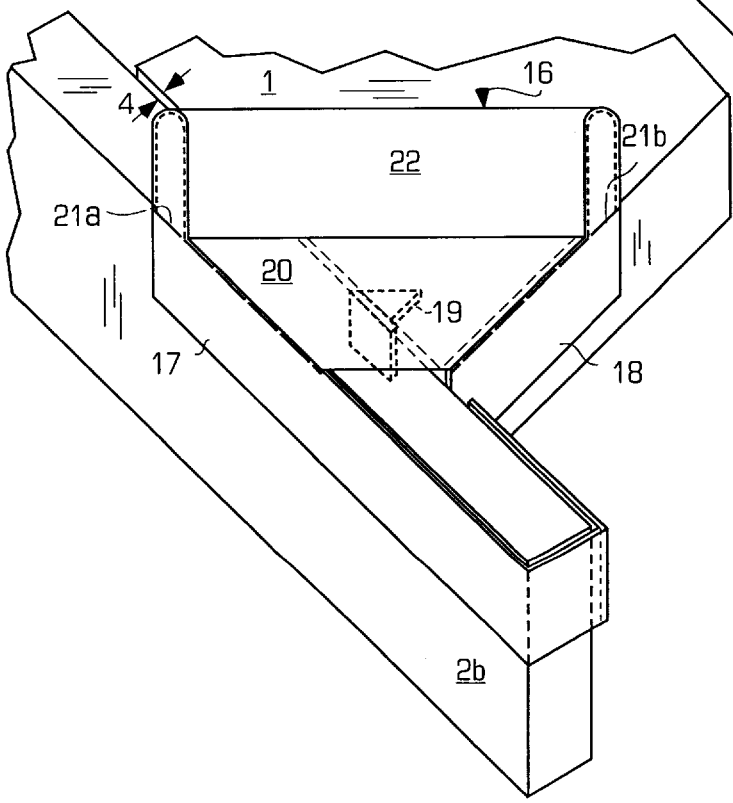
FIG. 6E illustrates the embodiment shown in FIG. 6D when the elongated flap is wrapped around the jamb member.

FIG. 6D illustrates another embodiment of the bottom clip in accordance with the invention with an elongated flap 17. In particular, the flap 17 of the bottom corner clip may be extended such that the flap attached to the jamb member is long enough to wrap around the end of the jamb member and be secured to the door as shown in FIG. 6E. The elongated flap 17 would, then hold the door and jamb member in a secure relationship so that the free rotation of the jamb member is eliminated and the door 14 can be shipped. In other words, elongated flap maintains the door and the free-swinging jamb member in a united relationship so that when the strapping is removed from the door assembly, the jamb member does not swing freely and is instead held fast against the door. Therefore, the door is much easier to ship. After shipping, the elongated flap 17 can be removed from the door assembly.

Figure 6F:
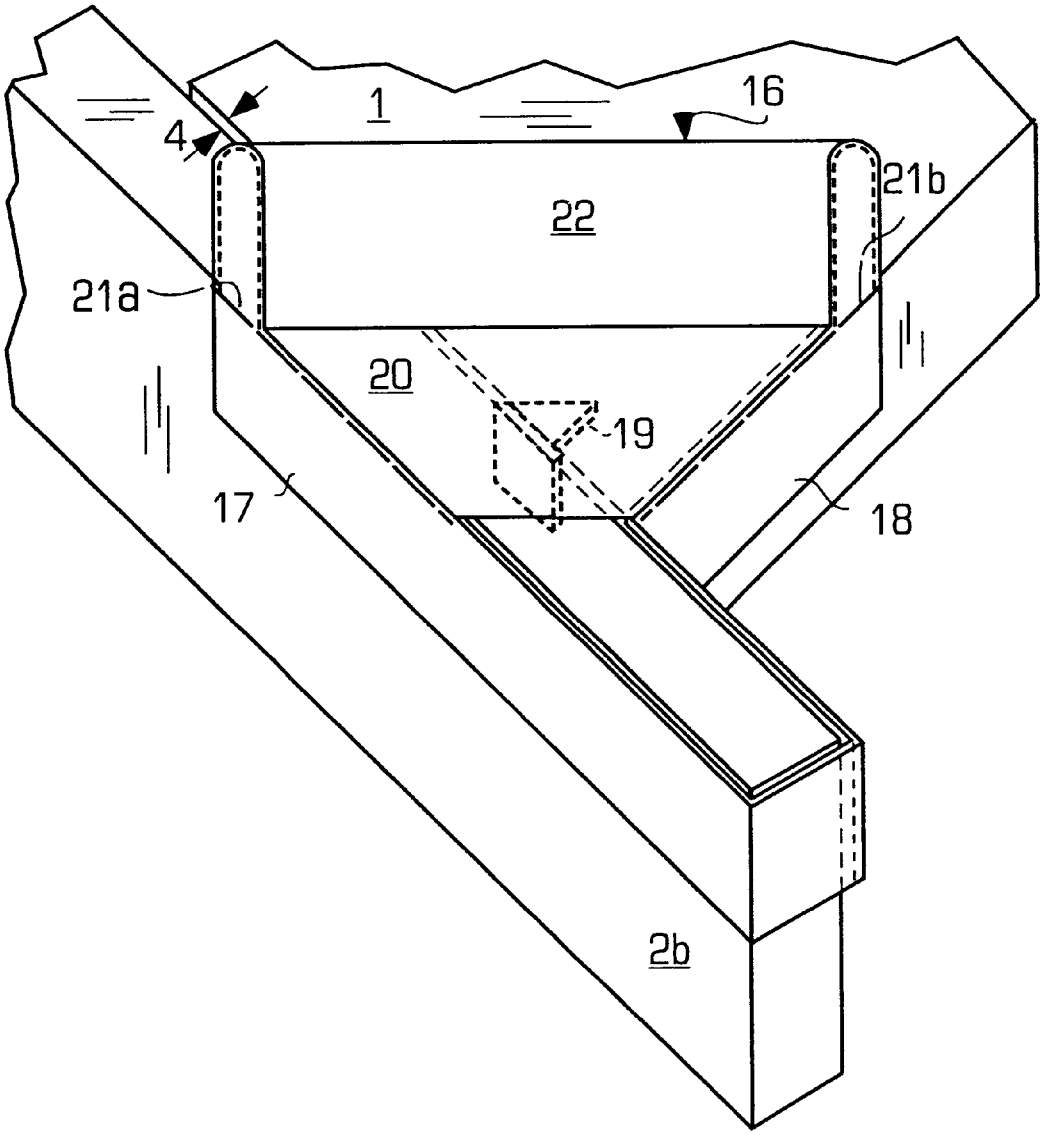
FIG. 6F illustrates another embodiment of the bottom clip wherein the first and second flaps are joined together to form a loop.

FIG. 6F illustrates another embodiment of the bottom clip wherein the first and second flaps are joined together to form a loop. In particular, the flap 17 and flap 18 may be integrally formed to form a loop of material which fits around the end of the jamb member and maybe secured in place. In this embodiment, the size of the loop is less adjustable than the embodiment above in which the flap 17 is wrapped around the end of the jamb member. However, for a company that has a door jamb assembly with predetermined dimensions for each door jamb assembly, the loop can be made to fit properly around the jamb member since the length of the jamb member to provide a custom fitted bottom corner clip.

FIGS. 7A and 7B illustrates a pre-hung door 1 and jamb assembly 2 in accordance with a preferred embodiment of the invention wherein the clips described above are installed onto the pre-hung door jamb assembly. In particular, the top corner clip 8 is attached to each of the top corners of the door 1 and jamb assembly 2. The bottom left corner clip 16 is attached to the bottom left corner of the door 1 and jamb assembly 2 and the bottom right corner clip 24 is attached to the bottom right corner of the door 1 and jamb assembly 2. With the clips attached to the door jamb assembly, the desired reveal space 4 is maintained, while keeping the door 1 closed during installation which permits a single installer to properly install the pre-hung door jamb assembly. Furthermore, the door 1 and jamb assembly 2 is protected from damage by the hinges 3 of other assemblies due to the protected ridges on the clips as shown in FIG. 7B so that the pre-hung door jamb assembly may be stacked together without damage.

The clips described above may be used in conjunction with a bottom strap as described in U.S. Pat. No. 6,357,200 which is owned by the same assignee. In accordance with another embodiment of the invention, the bracket 12 and the spacer 19 may be removed and the clips may be manufactured without them in circumstances when the clips are going to be used only for shipping and stability (and the reveal space is not important). When the spacer 19 of the bottom clip is not included in the bottom clip, the bottom clip may be used interchangeable for both the bottom right corner and the bottom left corner. The bottom clip without the spacer 19 may also be used (assuming that the strengthening of the joint capabilities of the top clip is not needed) for all four of the clips that are attached to the door jamb assembly so that a door maker/installer may simply stock the single clip. In this case, the flaps of the bottom clip (which is being used instead of the top clip) may act as a skid plate.

While the foregoing has been with reference to a particular embodiment of the invention, it will be appreciated by those skilled in the art that changes in this embodiment may be made without departing from the principles and spirit of the invention, the scope of which is defined by the appended claims.

What is claimed is:

1. A clip for temporarily securing a door to a first door jamb member and a second door jamb member, the clip comprising:

a base region;

a first and second flaps that extend down from the base region and attach to a first and second edge of the base region;

a support member that is attached to the base region at the intersection of the first and second edges of the base region, the support member extending down from the base region; and a bracket having a first and second portion that is positioned underneath the base region of the clip wherein a first door jamb member is positionable between the first portion of the bracket and the first flap, a second door jamb member is positionable between the second portion of the bracket and the second flap and the ends of the first door jamb member and the second door jamb member are postionable within the support member.

2. The clip of claim 1, wherein a first door jamb member is secured to the first flap and the second door jamb member is secured to the second flap and the ends of the first and second door jamb members are secured to the support member.

3. The clip of claim 2, wherein the clip is secured to the first door jamb member and the second door jamb member of a pre-hung door assembly and wherein a door is held shut by the base region.

4. The clip of claim 3 further comprises a protective ridge attached at a third edge of the base region, the protective ridge protecting the pre-hung door assembly from damage.

5. The clip of claim 4, wherein the protective ridge is integrally formed with the base region.

6. The clip of claim 3, wherein the clip comprises a plastic material.

7. The clip of claim 6, wherein the first and second flaps and the support member further comprise score lines so that the base region and bracket are removed when the door has been installed leaving the support member and the first and second flaps attached to the door jamb members.

8. The clip of claim 1 further comprises a protective ridge attached at a third edge of the base region, the protective ridge protecting the jamb members onto which the clip is installed from damage.

9. The clip of claim 8, wherein the base region further comprises a triangular region having the first, second and third edges wherein the first and second edges are of equal length and the third edge comprises the hypotenuse of the triangle.

10. The clip of claim 9, wherein the angle opposite of the third edge is 90°.

11. The clip of claim 10, wherein the first and second flaps are positioned perpendicular to the base region and the protective ridge is positioned perpendicular to the base region.

12. The clip of claim 1, wherein the base region further comprises a triangular region having the first, second and third edges wherein the first and second edges are of equal length and the third edge comprises the hypotenuse of the triangle.

13. The clip of claim 1, wherein the first and second portions of the bracket meet at substantially a right angle and the bracket is located in the center of the base region.

14. The clip of claim 13, wherein the first and second portions of the bracket have a predetermined thickness that is substantially equal to a desired space between the jamb members and the door.

15. A clip for temporarily securing a bottom of a door to a door jamb assembly having a horizontal door jamb member and a first and second vertical door jamb member and a door that is positioned within the door jamb assembly between the door jamb members, the clip comprising:

a base region;

a first and second flaps that extend down from the base region and attach to a first and second edge of the base region; and a spacer that is positioned underneath the base region of the clip wherein, when the clip is attached to a corner of the door, the first vertical door jamb member is positionable between the spacer and the first flap and the door is positionable between the spacer and the second flap.

16. The clip of claim 15, wherein the first flap is capable of being attached to the first vertical door jamb member and the second flap is capable of being attached to the door.

17. The clip of claim 16, wherein the clip is capable of being secured to the first door jamb member and the door of the pre-hung door assembly and wherein the door is held in a fixed position by the second flap.

18. The clip of claim 17 further comprises a protective ridge attached at a third edge of the base region, the protective ridge protecting the pre-hung door assembly from damage.

19. The clip of claim 18, wherein the protective ridge is integrally formed with the base region.

20. The clip of claim 17, wherein the clip comprises a plastic material.

21. The clip of claim 20, wherein the first and second flaps further comprise score lines so that the base region and spacer are removed when the door has been installed leaving the first and second flaps attached to the door jamb member and the door, respectively.

22. The clip of claim 15 further comprises a protective ridge attached at a third edge of the base region, the protective ridge protecting the jamb members onto which the clip is installed from damage.

23. The clip of claim 22, wherein the base region further comprises a trapezoid region having the first, second and third edges wherein the first and second edges are non parallel and of equal length and the third edge comprises a base of the trapezoid.

24. The clip of claim 23, wherein the first and second flaps are positioned perpendicular to the base region and the protective ridge is positioned perpendicular to the base region.

25. The clip of claim 24, wherein the spacer has a predetermined thickness that is substantially equal to a desired space between the jamb members and the door.

26. The clip of claim 15, wherein the base region further comprises a trapezoid region having a first, second and third edges wherein the first and second edges are non parallel and of equal length and the third edge comprises a base of the trapezoid.

27. The clip of claim 15, wherein the second flap further comprises an elongated flap that is wrapped around the first door jamb member and attached to the door.

28. A clip for temporarily securing a door to a first door jamb member and a second door jamb member, the clip comprising:

a base region;

a first and second flaps that extend down from the base region and attach to a first and second edge of the base region;

a support member that is attached to the base region at the intersection of the first and second edges of the base region, the support member extending down from the base region; and a protective ridge attached at a third edge of the base region, the protective ridge protecting the jamb members onto which the clip is installed from damage.

29. The clip of claim 28, wherein a first door jamb member is secured to the first flap and the second door jamb member is secured to the second flap and the ends of the first and second door jamb members are secured to the support member.

30. The clip of claim 29, wherein the clip is secured to the first door jamb member and the second door jamb member of a pre-hung door assembly and wherein a door is held shut by the base region.

31. The clip of claim 30, wherein the clip comprises a plastic material.

32. The clip of claim 31, wherein the first and second flaps and the support member further comprise score lines so that the base region and bracket are removed when the door has been installed leaving the support member and the first and second flaps attached to the door jamb members.

33. The clip of claim 28 further comprising a bracket having a first and second portion that is positioned underneath the base region of the clip wherein a first door jamb member is positionable between the first portion of the bracket and the first flap, a second door jamb member is positionable between the second portion of the bracket and the second flap and the ends of the first door jamb member and the second door jamb member are postionable within the support member.

34. The clip of claim 33, wherein the first and second portions of the bracket meet at substantially a right angle and the bracket is located in the center of the base region.

35. The clip of claim 34, wherein the first and second portions of the bracket have a predetermined thickness that is substantially equal to a desired space between the jamb members and the door.

36. The clip of claim 28, wherein the protective ridge is integrally formed with the base region.

37. The clip of claim 28, wherein the base region further comprises a triangular region having the first, second and third edges wherein the first and second edges are of equal length and the third edge comprises the hypotenuse of the triangle.

38. The clip of claim 37, wherein the first and second flaps are positioned perpendicular to the base region and the protective ridge is positioned perpendicular to the base region.

39. A clip for temporarily securing a bottom of a door to a door jamb assembly having a horizontal door jamb member and a first and second vertical door jamb members and a door that is positioned within the door jamb assembly between the door jamb members, the clip comprising:

a base region;

a first and second flaps that extend down from the base region and attach to a first and second edge of the base region; and a protective ridge attached at a third edge of the base region, the protective ridge, when attached to a corner of the door, adapted to extend vertically above the jamb members and protecting the jamb members onto which the clip is installed from damage.

40. The clip of claim 39, wherein the first flap is capable of being attached to the first vertical door jamb member and the second flap is capable of being attached to the door.

41. The clip of claim 40, wherein the clip is capable of being secured to the first door jamb member and the door of a pre-hung door assembly and wherein a door is held in a fixed position by the second flap.

42. The clip of claim 41, wherein the clip comprises a plastic material.

43. The clip of claim 42, wherein the first and second flaps further comprise score lines so that the base region and spacer are removed when the door has been installed leaving the first and second flaps attached to the door jamb member and the door, respectively.

44. The clip of claim 39 further comprising a spacer that is positioned underneath the base region of the clip wherein a first door jamb member is positionable between the spacer and the first flap and a door is positionable between the spacer and the second flap.

45. The clip of claim 44, wherein the base region further comprises a trapezoid region having the first, second and third edges wherein the first and second edges are non parallel and of equal length and the third edge comprises a base of the trapezoid.

46. The clip of claim 45, wherein the first and second flaps are positioned perpendicular to the base region and the protective ridge is positioned perpendicular to the base region.

47. The clip of claim 46, wherein the spacer has a predetermined thickness that is substantially equal to a desired space between the jamb members and the door.

48. The clip of claim 39, wherein the protective ridge is integrally formed with the base region.

49. The clip of claim 39, wherein the base region further comprises a trapezoid region having the first, second and third edges wherein the first and second edges are non parallel and of equal length and the third edge comprises a base of the trapezoid.

50. The clip of claim 39, wherein the second flap further comprises an elongated flap that is wrapped around the first door jamb member and attached to the door.

51. A clip for temporarily securing a bottom of a door to a door jamb assembly having a horizontal door jamb member and a first and second vertical door jamb members and a door that is positioned within the door jamb assembly between the door jamb members, the clip comprising:

a base region; and a first and second flaps that extend down from the base region and attach to a first and second edge of the base region, the ends of the first and second flaps being joined together and adapted to wrap around the first vertical door jamb member that extends beyond the door to secure the door to the first vertical jamb member.

52. The clip of claim 51, further comprising a protective ridge attached at a third edge of the base region, the protective ridge protecting the jamb members onto which the clip is installed from damage.

53. The clip of claim 52, wherein the protective ridge is integrally formed with the base region.

54. The clip of claim 51, wherein the clip comprises a plastic material.

55. The clip of claim 51 further comprising a spacer that is positioned underneath the base region of the clip wherein a first door jamb member is positionable between the spacer and the first flap and a door is positionable between the spacer and the second flap.

56. The clip of claim 55, wherein the spacer has a predetermined thickness that is substantially equal to a desired space between the jamb members and the door.

57. The clip of claim 51, wherein the base region further comprises a trapezoid region having the first, second and third edges wherein the first and second edges are non parallel and of equal length and the third edge comprises a base of the trapezoid.

58. The clip of claim 57, wherein the first and second flaps are positioned perpendicular to the base region and the protective ridge is positioned perpendicular to the base region.

59. A clip for a pre-hung door assembly having a door jamb assembly having a horizontal door jamb member and a first and second vertical door jamb members and a door that is positioned within the door jamb assembly between the door jamb members, the clip comprising:

a protecting ridge that is capable of resting on a first vertical door jamb member and a corner of the door within the door assembly, the protecting ridge also extending vertically above the vertical door jamb member to protect the first vertical door jamb member from damage;

a first flap that extends down from the protective ridge towards the door, the first flap capable of being attached to the door; and a second flap that extends down from the protective ridge towards the first vertical door jamb member, the second flap capable of being attached to the first vertical door jamb member and also adapted to be attached over the end of the vertical door jamb member that extends past the door to protect the end of the first vertical door jamb member.

60. The clip of claim 59, wherein the protective ridge is integrally formed with a base region.

61. The clip of claim 59, wherein the clip comprises a plastic material.

62. The clip of claim 59, wherein the first and second flaps are positioned perpendicular to the base region.

63. A clip capable of being attached to a pre-hung door assembly, having a door jamb assembly having a horizontal door jamb member and a first and second vertical door jamb members and a door that is positioned within the door jamb assembly between the door jamb members, the clip comprising:

a protecting ridge that is adapted rest on a bottom end of the first vertical door jamb member and a bottom corner of the door, the protecting ridge extending vertically above the first vertical door jamb member and door to protect the first vertical door jamb member and door from damage during shipping; and a flap that extends down from the protective ridge towards the first vertical door jamb assembly, the flap capable of being attached over a bottom end of the first vertical door jamb member when the clip is installed onto a corner of the pre-hung door assembly, the clip, when attached to the corner of the pre-hung door assembly, holding the door in a fixed position during installation and shipping and protecting the bottom end of the first vertical door jamb member and the bottom end of the door from damage during shipping and installation.

* * * * *